United States Patent [19]

Johnson

[11] 4,254,309

[45] Mar. 3, 1981

[54] SNAP-THROUGH CHARACTERISTIC KEYBOARD SWITCH

[75] Inventor: Dudley B. Johnson, Irving, Tex.

[73] Assignee: Texas Instruments Incorporated, Attleboro, Mass.

[21] Appl. No.: 970,505

[22] Filed: Dec. 18, 1978

Related U.S. Application Data

[63] Continuation of Ser. No. 678,104, Apr. 19, 1976, abandoned.

[51] Int. Cl.[3] ..... H01H 1/06; H01H 13/70

[52] U.S. Cl. ..... 200/5 A; 200/159 B; 200/275

[58] Field of Search ..... 200/5 R, 5 A, 52 R, 200/159 B, 275, 292, DIG. 1; 361/283

[56] References Cited

U.S. PATENT DOCUMENTS

| | | | |
|---|---|---|---|
| 3,718,791 | 2/1973 | Szablowski | 200/85 A |
| 3,749,859 | 7/1973 | Webb et al. | 200/275 X |
| 3,751,612 | 8/1973 | Hansen | 200/275 X |
| 3,796,843 | 3/1974 | Durkee et al. | 200/5 A |
| 3,800,104 | 3/1974 | Lien et al. | 200/275 X |
| 3,806,673 | 4/1974 | Boulanger | 200/275 X |
| 3,860,771 | 1/1975 | Lynn et al. | 200/5 A |
| 3,952,174 | 4/1976 | Boulanger et al. | 200/159 B X |
| 3,967,084 | 6/1976 | Pounds | 200/275 |
| 3,973,091 | 8/1976 | Kaminski | 200/159 B X |
| 3,993,939 | 11/1976 | Slavin et al. | 361/283 |
| 3,996,427 | 12/1976 | Kaminski | 200/159 B |
| 3,996,429 | 12/1976 | Chu et al. | 200/159 B X |
| 4,005,293 | 1/1977 | Boulanger | 200/275 X |
| 4,005,299 | 1/1977 | Keough | 200/159 B |
| 4,018,999 | 4/1977 | Robinson et al. | 200/275 X |
| 4,046,981 | 9/1977 | Johnson et al. | 200/159 B |
| 4,156,802 | 5/1979 | Gilano et al. | 200/5 A |
| 4,190,748 | 2/1980 | Langford | 200/275 X |
| 4,194,105 | 3/1980 | Hodges | 200/159 B |

FOREIGN PATENT DOCUMENTS

| | | | |
|---|---|---|---|
| 2263321 | 7/1974 | Fed. Rep. of Germany | 200/159 B |

*Primary Examiner*—James R. Scott
*Attorney, Agent, or Firm*—John A. Haug; James P. McAndrews; Melvin Sharp

[57] ABSTRACT

A keyboard switch actuating element having a concave central portion and a lip located at the periphery of the actuating element for providing a snap-through characteristic when the actuating element is disposed even over a smooth surface and the actuating element is depressed. The actuating element is typically disposed over conductors forming switch contacts affixed to the surface of a printing wiring board and closes the circuit between such switch contacts upon depression of the actuating element. The snap-through characteristic results from a reduction of the required force to depress the actuating element as the actuating element approaches its fully depressed state.

14 Claims, 9 Drawing Figures

COMPRESSIVE FORCE
A
B
F
DEFLECTION 8
10a
3
3
10a
11
8

10a
7
1
6

SNAP-THROUGH CHARACTERISTIC KEYBOARD SWITCH

This is a continuation of application Ser. No. 678,104, filed Apr. 19, 1976 now abandoned.

This invention relates to a keyboard switch actuating element and more particularly to keyboard switch actuating elements which are used in conjunction with a printed wiring board. As is well known to those skilled in the art, printed wiring boards have been utilized in virtually every segment of the electronics industry because of their increased reliability and decreased cost and size compared to hand wiring techniques. The substrate of these printed wiring boards have typically been of plastic composition material. The manufacturing process used with these plastic substrate boards has basically been subtractive in nature. That is, a plastic board is coated on one or both sides with a conductive material, such as copper. It is then masked in those areas where conductors are desired with a material which resists a subsequent chemical etching which removes the copper from those areas where conductors are not desired.

Non-plastic substrate printing wiring boards are also known in the prior art. The process used with these boards, such as metal substrate boards, has been conversely additive in nature. Methods of manufacturing metal substrate boards are disclosed in U.S. Pat. Nos. 3,934,334 and 3,934,335.

Prior art keyboard switches with printed wiring board structure are disclosed in U.S. Pat. No. 3,806,673 and U.S. Pat. No. 4,046,981. In the prior art, when operating a keyboard switch, an electrically conductive actuating element, which is a flexible and typically curved disc-shaped member, has been mounted in such a manner as to permit the center of the actuating element to travel beyond a plane defined by the perimeter of the actuating element before closing an electrical circuit controlled by the switch in order to convey to the person operating the key the feeling or sensation that the circuit has been completed. This "snap-through" sensation is a click imparted to the operator's fingers; this click is a highly desirable feature because it lets the operator know the data has been entered into the electronic circuit associated with the switch without the necessity of observing output devices connected to the electrical circuit. In the prior art, as is exemplified by U.S. Pat. No. 3,806,673, the actuating element has been mounted on relatively thick metallic conductors affixed to a printed wiring board manufactured according to this subtractive process and which exhibits the desirable "snap-through" feature because the relatively thick conductors raise the perimeter of the actuating element approximately 5 mils above the level of the substrate, permitting generation of the desirable click when the actuating element is depressed. This design is unsuitable for use with the printed wiring board manufactured according to additive technology because in excess of 50 hours of conductor plating time would be required to build up conductors of 5 mil thickness, thus substantially increasing the cost of the keyboard.

In the prior art, actuating elements as exemplified by U.S. Pat. No. 4,046,981, the actuating element is essentially unchanged from that disclosed in U.S. Pat. No. 3,806,673, but the actuating element is disposed over a depressed region in a metal substrate printed wiring board having relatively thin conductors formed according to additive technology. This prior art design, although providing a keyboard switch exhibiting the desired snap-through feature, complicates the manufacturing processes associated with the manufacture of a printed wiring board because of the need for a depressed region for each switch contact in the printed wiring board.

Also, in the prior art, there is known an actuating element exhibiting the desirable "snap-through" feature and having a somewhat triangular shape compared to the essentially circular shape of the aforementioned actuating elements. This prior art actuating element is provided with protuberances near the points of the triangle which serve like the relatively thick conductors in the aforementioned prior art switches in permitting the center of the actuating element to pass through a plane generally defined by its perimeter. This actuating element, while providing the desirable snap-through characteristic, also exhibits radially outward movement of the protuberances with respect to the geometric center of the actuating element when actuated. This radial movement is undesireable because it causes the underlying switch contact to wear during operation which in turn can eventually cause the switch to fail.

SUMMARY OF THE INVENTION

Briefly, in accordance with the switch herein described, relative thin conductors may be utilized, the actuating element may be disposed over a planar portion of the printed wiring board, and the desirable snap-through feature is retained. Generally in the preferred embodiment, the actuating element is disposed over a generally planar area of the printed wiring board having two contacts affixed thereon. Typically, the edge of the actuating element is in contact with one of the contacts and the second is generally covered by the actuating element in spaced relation thereto. The actuating element has at least one surface partially covered with conductive material which contacts the second contact and which will contact the first contact when the actuating element is depressed. The actuating element is generally disc-shaped, the central portion thereof being slightly concave with respect to the at least partially electrically conductive surface, and the periphery of the disc-shaped actuating element has a lip which is located at an angle to the central portion of the actuating element. Given the novel shape of the actuating element, when a compressive force is applied between the central portion of the actuating element and the printed wiring board, the force at first increases with movement of the central portion towards the printed wiring board, but then decreases before the conductive surface of the central portion contacts the first contact. This first increasing and then decreasing force characteristic yields the desirable snap-through feature. Other embodiments are disclosed, including a plurality of essentially identical actuating elements connected to a lead frame.

It is one object of this invention to improve keyboard switch actuating elements.

It is yet another object of this invention to provide a keyboard switch actuating element well suited for use with printed wiring boards manufactured according to additive technology.

It is yet another object of this invention to provide a keyboard in which a "click" is imparted to the finger of the operator when a switch is depressed.

It is still yet another object of this invention to provide a keyboard switch actuating element for use in a generally planar portion of a printed wiring board.

It is yet another object of this invention to provide an actuating element which exhibits no or very little radial movement of its peripheral edge during switch operation.

In accordance with one feature of this invention, a keyboard is incorporated into a generally planar portion of a printed wiring board manufactured according to additive technology which imparts a "click" to the finger of the operator when a key is depressed.

In accordance with another feature of this invention, a plurality of keyboard switch actuating elements connected to a lead frame may be installed on a printed wiring board to form a keyboard thereon.

In accordance with yet another feature of this invention, the peripheral edge of the actuating element exhibits little or no radial movement during switch operation.

These and other objects and features in the invention will be evident from the following detailed description and claims with reference to the drawings.

DETAILED DESCRIPTION

Figure 1:
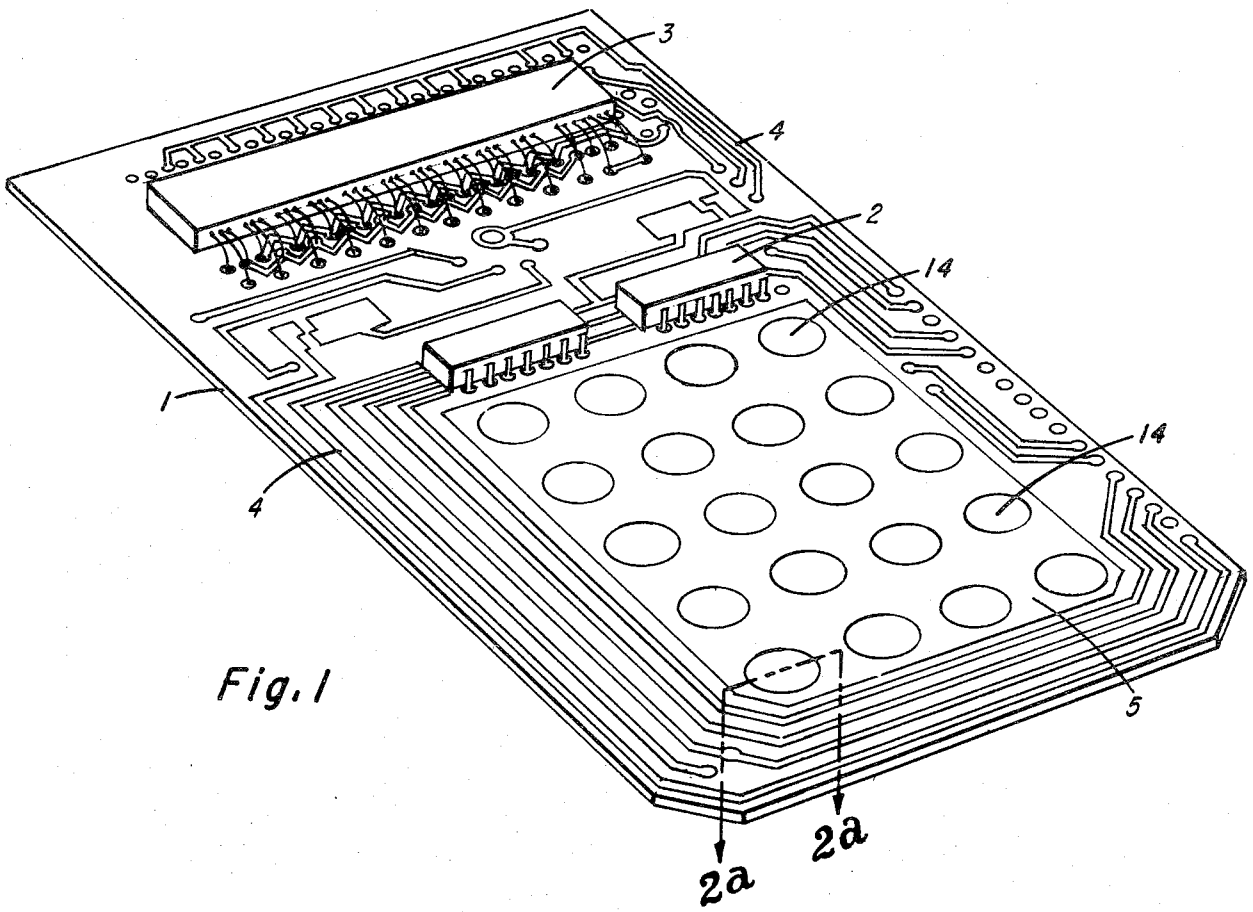
FIG. 1 is a perspective view of a printed wiring board embodying the present invention.

Referring now to FIG. 1, an assembly embodying the present invention is shown which includes a substrate 1, switches 14 mounted on a substrate to form a keyboard, an integrated circuit 2 and display devices 3 mounted on substrate 1. Conductors 4 interconnecting the switches 14, the integrated circuit 2, and the display devices 3 are shown on the substrate 1. A solder mask 5 covers selected areas. By adding a switch, batteries, interconnecting wires and a case with key push buttons (not shown) to the above described assembly, a hand-held electronic calculator results.

Figure 2A:
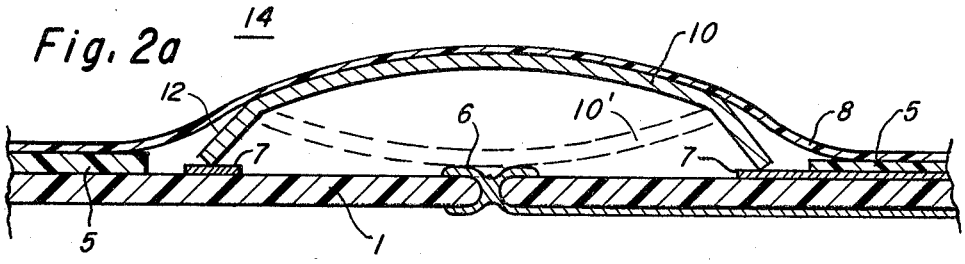
FIG. 2*a* is a sectional side view of a key illustrated in FIG. 1 this section being shown at 2*a*—2*a* in FIG. 1.
Figure 2B:
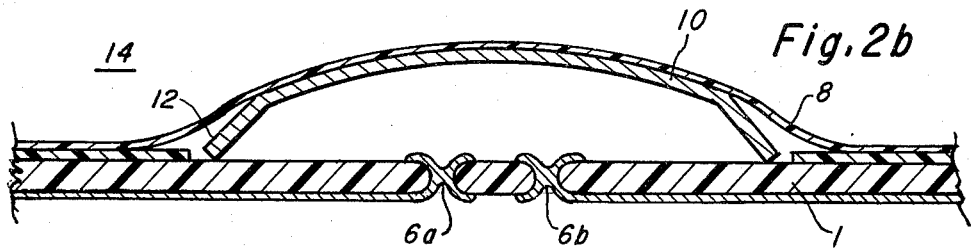
FIG. 2*b* is a sectional side view of another embodiment of a keyboard switch shown in FIG. 1.

Now referring to FIGS. 2*a* and 2*b*, there is shown in FIG. 2*a* a sectional side view of a switch 14 located on a printed wiring board and there is shown in FIG. 2*b* a sectional side view of another embodiment of a switch 14 located on a printed wiring board. In FIG. 2*a*, a substrate 1 is shown with a first switch contact 6 disposed under actuating element 10 in spaced relation thereto and a second switch contact 7 is affixed to substrate 1 and disposed at the lower edge of actuating element 10 making electrical contact therewith. An optional protecting layer, such as a solder mask 5, may be provided over the conductor connected to second switch contact 7 and over substrate 1. A retaining film 8 is disposed over actuating element 10 and the optional protecting layer 5, thus maintaining the position of actuating element 10 over first switch contact 6 and second switch contact 7.

Figure 6:
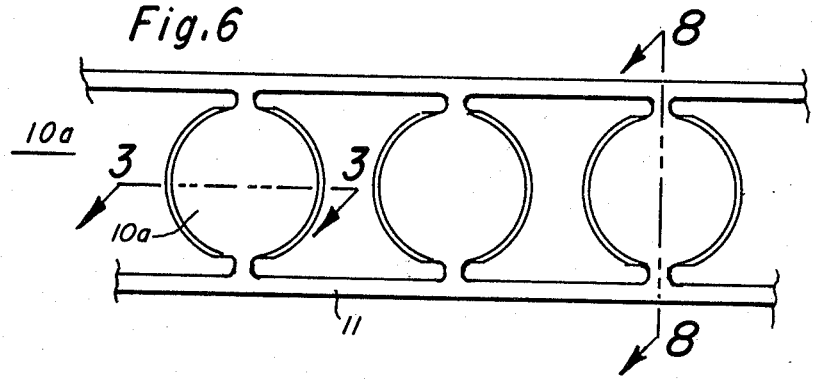
FIG. 6 is a top view of the lead frame mounted actuating elements depicted in FIG. 5.

The switch 14 is operated by depressing retaining film 8 in-way-of actuating element 10, causing actuating element 10 to deflect and make electrical contact with first switch contact 6, thus closing the circuit between first switch contact 6 and second switch contact 7. Actuating element 10 is shown in a depressed position as dotted line 10'. To permit trapped air to escape from the key when depressed, a duct, such as that shown in FIG. 2*b* and 6*b* of U.S. patent application Ser. No. 644,206 now U.S. Pat. No. 4,046,981 in the protecting layer 9 or alternatively a small air passage through substrate 1 in-way-of switch 14 should be provided. If 10 or more switches 14 are utilized, the ducts may be interconnected and the keyboard environmentally sealed because the combined volume of 10 switches 14 is sufficient to permit a single switch 14 to be depressed with little additional effort.

An alternate embodiment of the invention is depicted in FIG. 2*b*, where there is shown two switch contacts 6*a* and 6*b* disposed under actuating element 10. Otherwise, the structure and operation of this embodiment is similar to the switch depicted in FIG. 2*a* and hereinbefore described, except that actuating element 10, when deflected, contacts both switch contacts 6*a* and 6*b*.

Figure 3:
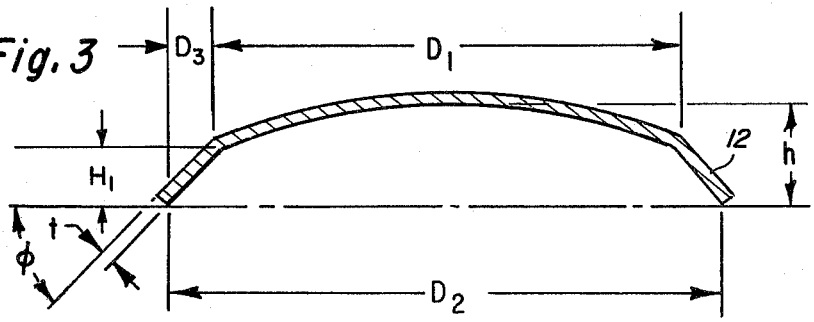
FIG. 3 is a sectional side view of the actuating element including letters relating to particular dimensions.

Referring now to FIG. 3, there is shown a side section view of the actuating element with certain dimensions indicated by letters. The actuating element 10 is typically disc-shaped as shown in FIG. 1 and is typically manufactured from sheet stainless steel or sheet brass having a thickness of 0.003 to 0.006 inch but preferably 0.004 inch. While other materials could be used, such as ordinary steel, aluminum, copper, or plastic having a conductive surface, I prefer to use stainless steel or brass because of the durability and resistance to oxidation thereof. If a plastic actuating element 10 is selected, then it should comprise a disc-shaped membrane having at least one partially electrically conductive surface. The major central portion of the membrane, being that portion denoted by diameter D1 in FIG. 3, is slightly concave. The periphery of the disc-shaped membrane includes a lip 12, being that portion of the actuating element 10 extending outwardly of diameter D1 to the edge of actuating element 10 denoted by diameter D2 in FIG. 3 and making an angle with the major central portion and an angle $\phi$ to the plane generally defined by the edge thereof. Lip 12 essentially forms a portion of a solid truncate cone which occurs when the surface $(H_1 \times D_1)/2 + (H_1 \times D_3)2$ is revolved through 360°; the $(H_1 \times D_1)/2$ surface is a rectangie extending outwardly in the geometric center to lip 12 and the $(H_1 \times D_3)/2$ surface is the triangle extending outwardly from the aforementioned rectangle immediately adjacent to lip 12. This lip provides actuating element 10 with a fairly rigid perimeter which, in turn, tends to restrict radial movement of the edge of the lip during operation thereby limiting any wear occuring at switch contact 7.

I have found that as the degree of concavity of the central portion of the membrane increases, the switch requires more force to operate it, while as the degree of concavity decreases, the snap-through characteristic may be lost. In the practice of my invention, I prefer an actuating element having the following dimensions in reference to FIG. 3: t=0.004 inch nominal thickness; $D_1$=0.350 inch nominal; $D_2$=0.373 inch nominal; h=0.016 inch nominal and $\phi$=30° nominal. These dimensions are exemplary and, of course, other dimensions will found to be operable within the spirit and scope of my invention. Further in the practice of my invention, I prefer to use an alloy of brass, known as Alcoloy 688, which is readily available in sheet form and which is readily formable by conventional metal forming techniques to form my actuating elements 10. To form an actuating element having the aforementioned dimensions, I first blank out discs to an 0.375 inch diameter and then coin the resulting disc with a circular tool having a 0.350 inch diameter and having a rounded head of 0.775 inch radius.

Figure 4:
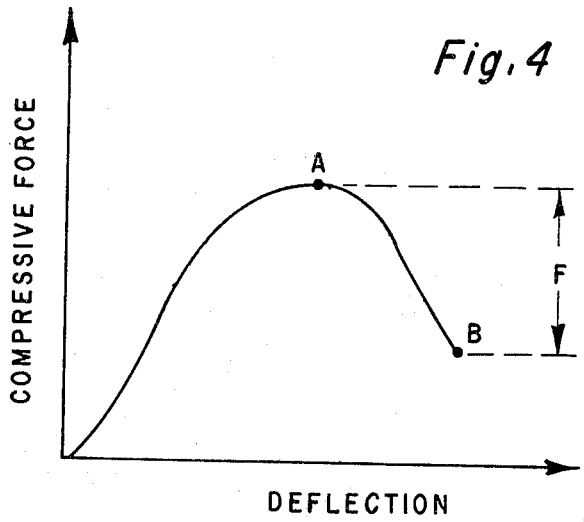
FIG. 4 is a graph of the force required to depress the actuating element versus deflection of the actuating element.

Referring now to FIG. 4, there is shown a graph of compressive force versus deflection from an actuating element. At the point of zero deflection, i.e., when the actuator is at rest, there is of course no compressive force applied. As the compressive force increases, for instance, as when an operator depresses the switch, the actuating element deflects towards the first switch contact 6 (FIG. 2*a*) with the increasing force until point A is reached, at which time the force needed to go to full closure of the switch, that represented by point B, is then exceeded and the actuating element at point A then very quickly "snaps through" to point B, closing the circuit and imparting a "click" to the finger of the operator. The compressive force differential F between points A and B provides the snap through effect and imparts the feeling to the finger of an operator. I have found that a switch provides a highly acceptable subjective feel to an operator if the force required at point B is in the range of approximately 5 to 10 ounces and the force differential F between points A and B is on the order of 2 ounces. An actuating element having the materials and dimensions described above exhibits an acceptable subjective feel to an operator.

Even given the improved wear characteristic of my actuating element, I prefer to further protect the second switch contact 7 (FIG. 2) from wear during operation, by using a switch contact 7 comprised of copper with a layer of nickel-boron covering the copper. Methods of adhering nickel-boron clad copper switch contacts to a substrate, such as plating first the copper and then the nickel-boron, are well known in the art.

Figure 7:
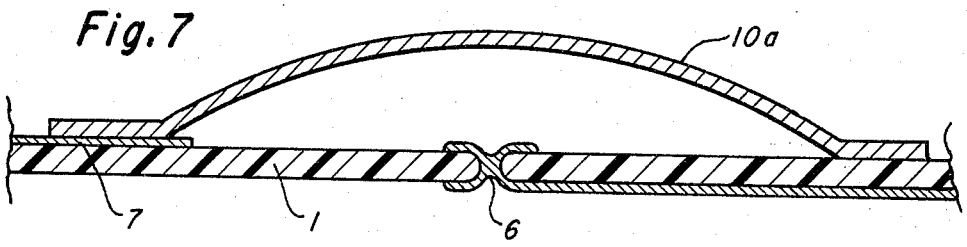
FIG. 7 is a sectional side view of a lead frame mounted actuating element, this section being depicted at 7—7 in FIG. 5.
Figure 5:
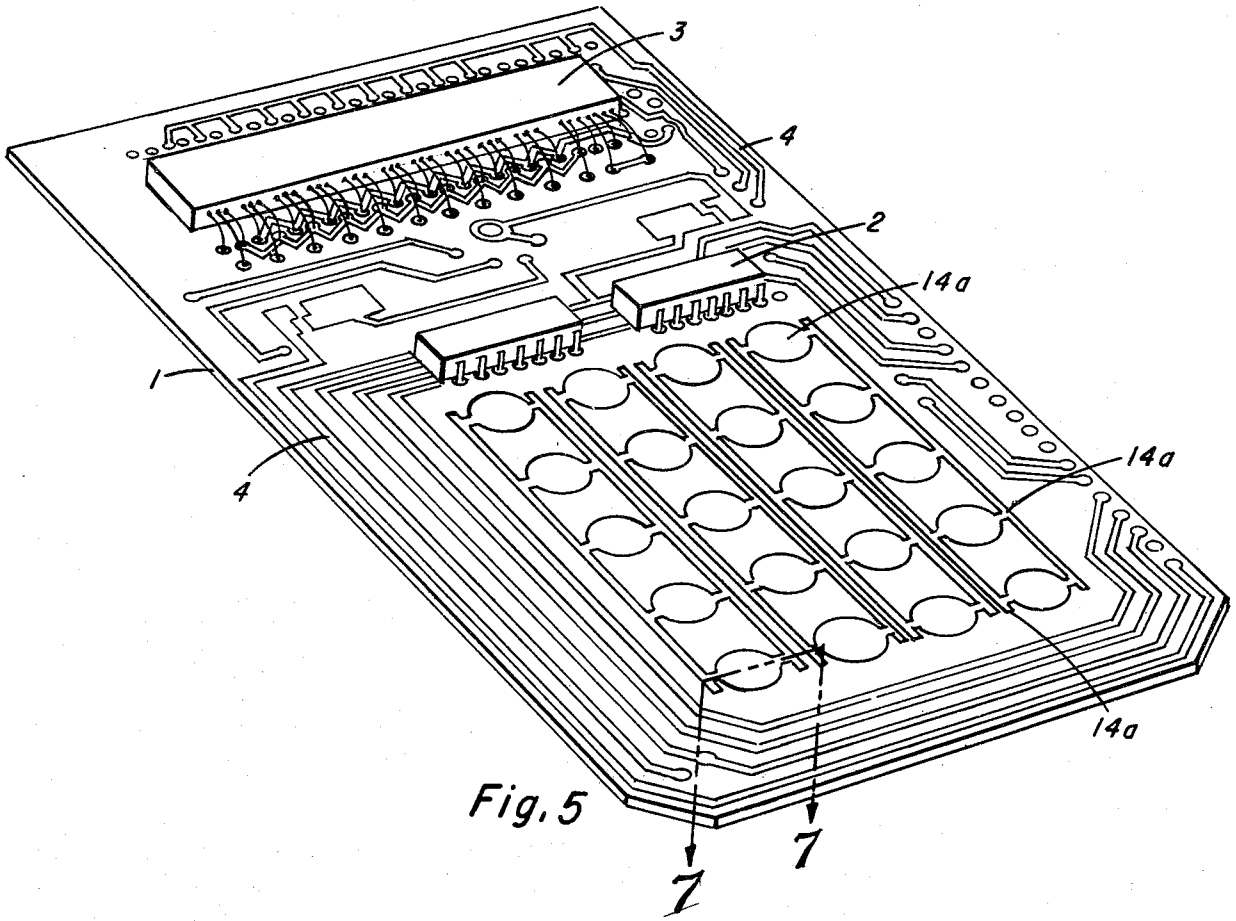
FIG. 5 is a perspective view of a printed wiring board embodying another embodiment of the invention.
Figure 8:
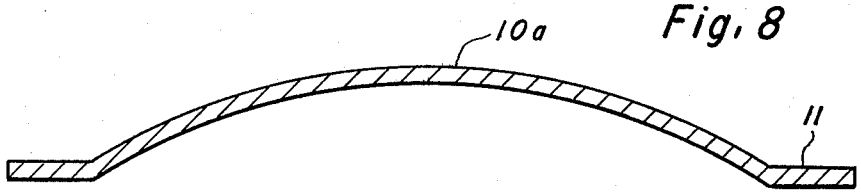
FIG. 8 is a section view of a lead framed actuating element; this section is shown at 8—8 in FIG. 6.

Referring now to FIG. 5, there is shown a perspective view of a printed wiring board including a keyboard utilizing an alternate embodiment of my actuating element. This actuating element 10*a* is integrally connected to a lead frame 11 as more clearly shown in FIG. 6. In this embodiment, my actuating element is integrally connected to a lead frame 11, generally retaining the shape of actuating element 10, except for the modification made to actuating element 10*a* at the point of connection to lead frame 11. Thus a section view taken through actuating element 10*a* along a line located perpendicular to the point of connection to lead frame 11 results in a cross sectional view being essentially the same as the cross section view through my non-lead frame actuating element 10, FIG. 3. Since the lead frame 11 connects integrally to opposed sides of the central portion of actuating element 10*a*, the actuating element peripheral lip 12 is not provided at the point of connection, as is shown in FIGS. 7 and 8. However, I have found that its deletion in these areas does not unduly affect operation of the switch. I prefer to connect the lead frame 11 integrally with the central major portion of actuation element 10*a*, in lieu of connecting the lead frame 11 to the peripheral lip of actuating element 10*a*, because the latter connection would tend to produce a sharp bend between the lead frame connection and the lip. Such a sharp connection would induce higher stresses in the connection during switch operation, thereby tending to reduce the life of the switch due to fatigue cycling. Otherwise, this lead frame embodiment of my actuating element is identical to my non-lead frame embodiment in configuration and operation. It should be evident that this lead frame embodiment is well suited for use in a calculator system utilizing a keyboard having X-Y matrix logic.

FIG. 8 is a sectional view of actuating element 10*a* through its point of connection to lead frame 11; FIG. 7 is similar to FIG. 8, which shows actuating element 10*a* including lead frame 11 mounted on substrate 11, as can also be seen in FIG. 5.

Having described my invention in connection with certain specific embodiments thereof, it is to be understood that further embodiments may now suggest themselves to those skilled in the art. It is understood that the invention is not to be limited to the specific embodiment except as set forth in the appended claims.

What is claimed is:

1. A keyboard switch comprising:

(a) a substrate having at least one major surface of insulating material;

(b) first and second switch contacts affixed to said substrate and disposed in essentially the same plane; and (c) a snap acting actuating element having a generally disc-shaped membrane which includes an electrically conductive major surface, a major central portion of said disc-shaped membrane being at least slightly upwardly concave with respect to said conductive surface and the periphery of said disc-shaped membrane having a lip which extends substantially around the entire periphery of said membrane, disposed at an angle to said central portion defining a truncated cone, the peripheral edge of said lip essentially lying in a plane, said actuating element being disposed over said first switch contact and on said substrate, said lip thereof contacting said second switch contact and making an electrically conductive connection between said second switch contact and said conductive surface;

said first and second switch contacts being electrically connectable by the conductive surface of said actuating element to provide an electrically conductive path therebetween in response to a compressive force applied between said central portion and said substrate causing said central portion to contact said first switch contact, said force at first increasing with movement of said central portions towards said first switch contact and then decreasing before said central portion contacts said first switch contact.

2. The combination of claim 1, wherein said actuating element comprises a metallic disc-shaped membrane.

3. The combination of claim 1, wherein said actuating element comprises a disc-shaped membrane selected from the group consisting of steel, copper, aluminum, brass and alloys thereof.

4. The combination of claim 1, wherein said substrate comprises a metal substrate covered at least in part by insulating material.

5. A keyboard switch actuating element comprising a generally disc-shaped snap acting membrane having an electrically conductive surface, a major central portion of said disc-shaped membrane being at least slightly upwardly concave with respect to said conductive surface and the periphery of the disc-shaped membrane having a lip which extends substantially around the entire periphery of said membrane, disposed at an angle to said central portion and defining a truncated cone, the peripheral edge of said lip essentially lying in a plane for disposing said central portion a pre-determined distance from said plane when said actuating element is in an at rest position and for bringing the conductive surface of said central portion into contact with said plane when a compressive force is applied therebetween, said force first increasing with movement of said central portion toward said plane and then decreasing before said central portion contacts said plane.

6. The keyboard switch actuating element according to claim 5, wherein said disc-shaped membrane comprises a metallic substance.

7. The keyboard switch actuating element according to claim 5, wherein the material of said disc-shaped membrane is selected from the group consisting of steel, copper, aluminum, brass and alloy thereof.

8. A keyboard switch comprising:

(a) a substrate having at least one major surface of insulating material;

(b) first and second switch contacts affixed to said substrate and disposed on essentially the same plane; and (c) a snap acting actuating element having a generally disc-shaped membrane, which includes an electrically conductive major surface, a major central portion of said disc-shaped membrane being at least slightly upwardly concave with respect to said conductive surface and the periphery of said disc-shaped membrane having a lip which extends substantially around the entire periphery of said membrane, disposed at an angle to said central portion and defining a truncated cone, the peripheral edge of said lip essentially lying in a plane, said actuating element being disposed over said first and second switch contacts on said substrate;

said first and second switch contacts being electrically connectable by the conductive surface of said actuating element to provide an electrically conductive path therebetween in response to a compressive force applied between said central portion and said substrate causing said central portion to contact said first and second switch contacts, said force first increasing with movement of said central portion towards said first and second switch contacts and then decreasing before said central portion contacts said first and second switch contacts.

9. The combination of claim 8 wherein said actuating element comprises a metallic disc-shaped membrane.

10. The combination of claim 8 wherein said actuating element comprises a disc-shaped membrane selected from the group consisting of steel, copper, aluminum, brass and alloys thereof.

11. A keyboard switch comprising:

(a) an essentially planar substrate having a least one major surface of insulating material;

(b) a plurality of first switch contacts affixed to said substrate;

(c) at least one second switch contact affixed to said substrate; and P1 (d) a lead frame having a conductive surface and including a plurality of snap acting actuating elements, each said actuating element being a generally disc-shaped membrane, which includes an electrically conductive major surface connected to said conductive surface of said lead frame, the central portion of said disc-shaped membrane being at least slightly upwardly concave with respect to said conductive surface and connected to said lead frame, the periphery of said disc-shaped membrane having a lip which extends substantially around the entire periphery of said membrane, disposed at an angle to said central portion and defining a truncated cone, the peripheral edge of said lip essentially lying in a plane, said actuating elements being disposed over said first switch contacts and on said substrate, said lead frame being interconnected with said second switch contact making an electrically conductive connection between said second switch contact and said conductive surface of said plurality of actuating elements;

said second switch contact being selectively connectable to said first switch contacts by the conductive surface of said lead frame and said actuating elements disposed over said first switch contacts to provide electrically conductive paths therebetween in response to compressive forces selectively applied between said central portions and said substrate, the force at first increasing with movement of said central portions towards said substrate and then decreasing before said central portions contacts the selected one of said first switch contacts.

12. The combination of claim 11 wherein said lead frame and plurality of actuating elements comprises a metallic material.

13. The combination of claim 11 wherein material of said lead frame and plurality of actuating elements is selected from the group consisting of steel, copper, aluminum, brass and alloys thereof.

14. A snap-action element for use with an essentially planar keyboard, said element comprising a generally disc-shaped, metallic member having an at least slightly upwardly concave surface, the periphery of said member having a continuous lip disposed at an angle to the concave surface of said member, said lip being a portion of a truncated conical surface of revolution.

* * * * *